US010092822B2

(12) United States Patent
Chiarolanzio

(10) Patent No.: US 10,092,822 B2
(45) Date of Patent: Oct. 9, 2018

(54) GAME OF STRATEGY, MEMORY, AND CHANCE

(71) Applicant: John Chiarolanzio, New Platz, NY (US)

(72) Inventor: John Chiarolanzio, New Platz, NY (US)

( * ) Notice: Subject to any disclaimer, the term of this patent is extended or adjusted under 35 U.S.C. 154(b) by 285 days.

(21) Appl. No.: 15/042,654

(22) Filed: Feb. 12, 2016

(65) Prior Publication Data

US 2016/0236069 A1 Aug. 18, 2016

Related U.S. Application Data

(60) Provisional application No. 62/115,706, filed on Feb. 13, 2015.

(51) Int. Cl.
*A63F 3/02* (2006.01)
*A63F 3/00* (2006.01)

(52) U.S. Cl.
CPC ..... *A63F 3/02* (2013.01); *A63F 2003/00022* (2013.01); *A63F 2003/00208* (2013.01); *A63F 2003/00712* (2013.01)

(58) Field of Classification Search
None
See application file for complete search history.

(56) References Cited

U.S. PATENT DOCUMENTS

2014/0084539 A1* 3/2014 Dolk ..... G09B 19/22 273/260
2015/0042043 A1* 2/2015 Dolk ..... A63F 3/02 273/260

* cited by examiner

*Primary Examiner* — Sunit Pandya

(57) ABSTRACT

A game is disclosed having two or more players, each player has a set of game pieces with the same front, and the back having an indication of rock, paper, or scissors. A game board has pre-designated positions for initial positioning of each player's game pieces such that each player may see the back of their respective game pieces and only the front of any other players', one of the positions being the winning position. In turn, each player moves any of their game pieces to an adjacent open position or may challenge another player to a position occupied by that player, the challenge being resolved in the traditional manner. The losing piece is removed from the board or, if a tie, the game pieces are left unchanged. Play ends upon one player occupying the winning position without being able to be challenged by any remaining player.

7 Claims, 3 Drawing Sheets

GAME OF STRATEGY, MEMORY, AND CHANCE

RELATED APPLICATION DATA—CLAIM TO PRIORITY

This application is based on provisional application Ser. No. 62/115,706, filed Feb. 13, 2015 entitled Game of strategy, memory and chance.

BACKGROUND OF THE INVENTION

FIELD OF THE INVENTION

The present invention refers in general to the field of games, and more particularly, to a game of strategy, memory and chance.

BRIEF SUMMARY OF THE INVENTION

It is an object of the present invention to provide an improved game of strategy, memory and change.

It is a related object of the present invention to provide an improved game based on a long known and widely know game played by many.

In accordance with a preferred embodiment of the present invention, a game of strategy, memory and chance comprises two or more players, each player having a set of game pieces, the set of game pieces being the same for each player in all respects except in some distinguishing characteristic so that each player can distinguish one player's game pieces from the one or more other player's game pieces, each set of game pieces having the same front appearance, and each game piece having at least three types of back appearances, the first type winning over the second type, the second type winning over the third type and the third type winning over the first type, a game board having a plurality of positions, pre-designated game board positions are set for initial positioning of each player's game pieces such that each player may see the back of their respective game pieces and only the front of any other player's game pieces, one of the game board positions being the winning position, in turn, each player may move any one of their game pieces to an adjacent open board position or may challenge another player to a board position occupied by that other player, in the event of a challenge, each player reveals to the other the back of the player's game piece, the game board position is then occupied by the winner and the losing piece is removed from the game board or the game piece positions are left unchanged in the event both game pieces are of the same type, play ends upon one player occupying the winning position without being able to be challenged by any remaining player.

Other objects and advantages will become apparent from the following descriptions, taken in connection with the accompanying drawings, wherein, by way of illustration and example, embodiments of the present invention are disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
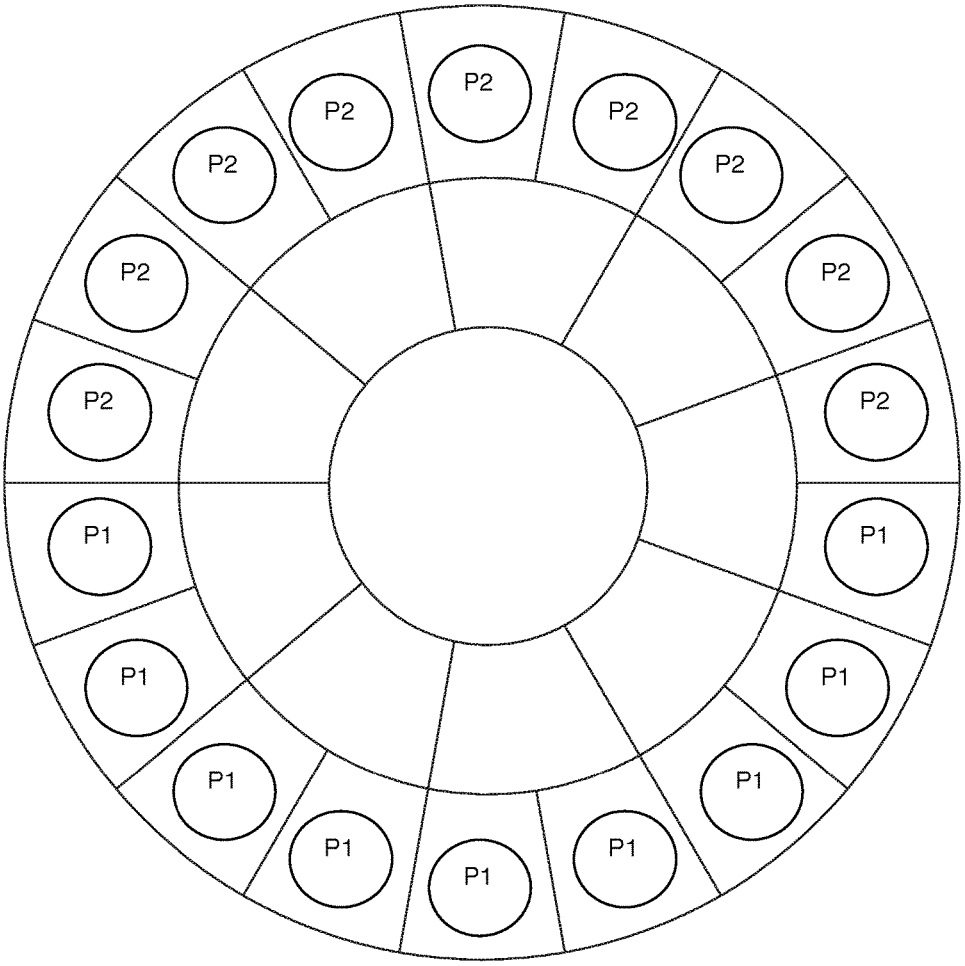
FIG. 1 is a view of the board game in accordance with a preferred embodiment of the present invention showing the Board layout, and starting position of game pieces.

Turning to the Figures, the game is played on a board between two or more players. The Board may be a virtual board if played electronically, or may be a physical board. In the preferred embodiment, the board has a layout as shown in FIG. 1, having three consecutive circles. The center circle is one space, the next larger section, or first annulus, is partitioned into 9 equal spaces, and the next larger section, or second annulus, is partitioned into 18 equal spaces. It will be appreciated that any number of concentric circles may be used as desired, defining any number of annulusi, and that each may be partitioned into any number of equal spaces. Further, though the illustrated Board embodiment is shown with concentric circles, any desired shape may be employed. In addition, though concentric circles are described with a single circle space at the center, other configurations may be used that allow competing players to compete for a particular space or spaces. Further, in the particular embodiment described, the Board is configured as a cylinder with the top portion removable and the interior being hollow so that the game pieces may be stored therein.

Figure 3:
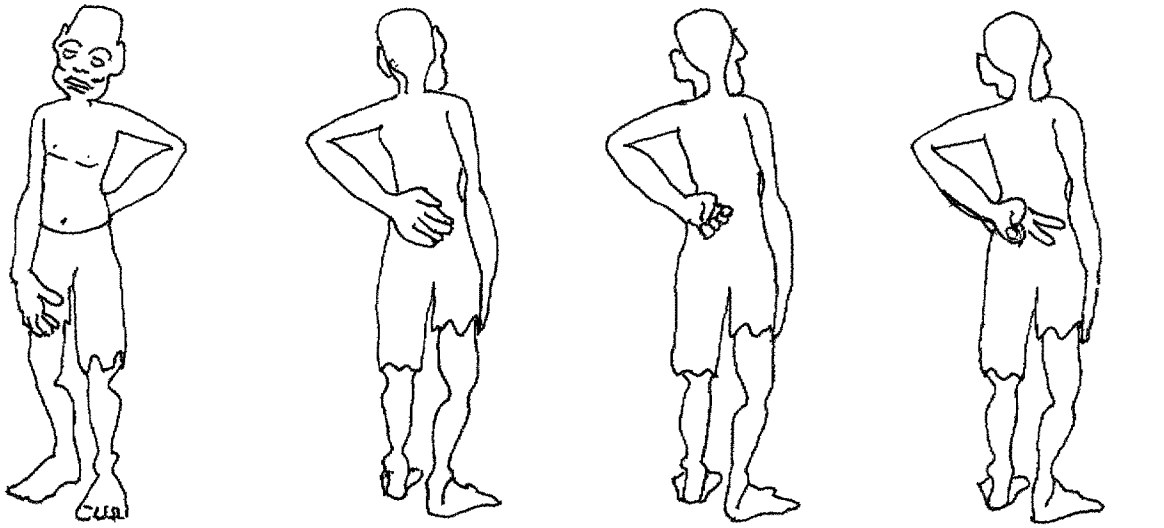
FIG. 3 is a front view of a one set game pieces, and the back view of three different game pieces in accordance with a preferred embodiment of the present invention.

A set of green game pieces or pawns consisting of 3 Rock, 3 Paper, and 3 Scissors is also provided. In the preferred embodiment, each pawn may take any shape or depiction such as a person, male or female, a ghost, a ghoul, any animal, etc. without departing from the intention of the invention. Particularly, though, each pawn for each player is configured having a front side and a back side, wherein the front side off all of one player's pieces are identical, and the back side has an indication of either Rock, Paper, or Scissors. Such Rock, Paper, Scissors, may be depicted with a letter such as R, P, S, or may be a hand showing the traditional closed fist signifying Rock, extended prone hand signifying Paper, and the first two fingers split signifying Scissors, or any other appropriate depiction. It will be appreciated that any number of pawns may be provided and in any configuration of Rock, Paper, or Scissors. The important aspect is to allow neither player to have an unfair advantage over the other. For an alternate example, each player may be allowed to select the number of Rock's Paper's and Scissors's up to the total number of pawns allowed, or may be limited to an equal number of each, as in the preferred embodiment. Any color may be used, or any shape, as long as one player's set of pawns is distinguishable from another player's set of pawns. An exemplary depiction of the front of a set of game pieces, as well as the three types of backs of a set of game pieces is shown in FIG. 3.

A set of blue game pieces or pawns consisting of 3 rock, 3 paper, and 3 scissors is also provided. As described in connection with the set of green pawns, above, the pawns may take a large number of variations. More sets of pawns may be provided, depending upon the number of players desired. In the illustrated preferred embodiment, two sets of pawns, one for each of two players is provided. As the number of players increases, the number of pawns may be varied, as well as the number of spaces on the Board, described above.

The game is won when one player is in the Board's center space with a pawn that cannot be taken by an opponent. This happens when all of their pawns that beat it have been removed from the Board. For example: Blue moves a Rock pawn into the center space after taking all of Green's Paper pawns. Without a Paper pawn, it is impossible for Green to take Blue's Rock, and Blue wins.

The game is started with each Player placing their pawns next to each other on the outermost annulus or ring so that they control one half of the outer ring. Players may place the Rock, Paper, and Scissors pawns as they choose. Alternately, the players may take turns placing one or more pawns at a time until all the pawn are placed. In the preferred embodiment, and as illustrated in FIG. 1, each player is designated adjacent spaces along half the outermost ring, though this is not required of the invention, and there may be more spaces in the outer annulus than the total number of pawns. Players may intersperse their pawns on non-adjacent spaces, or place their pawns on spaces other than on the outermost ring, depending on desired play. An important feature is that in placing pawns, one player is not subject to an unfair advantage over another player. In placing their pawns, it is important and an aspect of the invention that the front side, i.e., the side that is the same for all pawns of any player, faces the opposing player, and the back side of each pawn of any player faces the player. In this way, opposing players do not see the back side of their opponents' pawn, so they do not know if the pawn is a Rock, a Paper, or a Scissors. As will be appreciated, as the number of players increases, the number of sides of the Pawns that are the same in a player's set must increase so as to allow the type of pawn, i.e., Rock, Paper, or Scissors, to be unknown by the other players.

After pawns are placed, players use traditional Rock, Paper, Scissors hand game to determine who goes first. If there more than two players, the remaining players can play the Rock Paper, Scissors game to determine which player goes second, and so forth. Alternate ways of choosing the order of players may be used and are well know such as drawing cards, rolling one or more die, etc.

Figure 2:
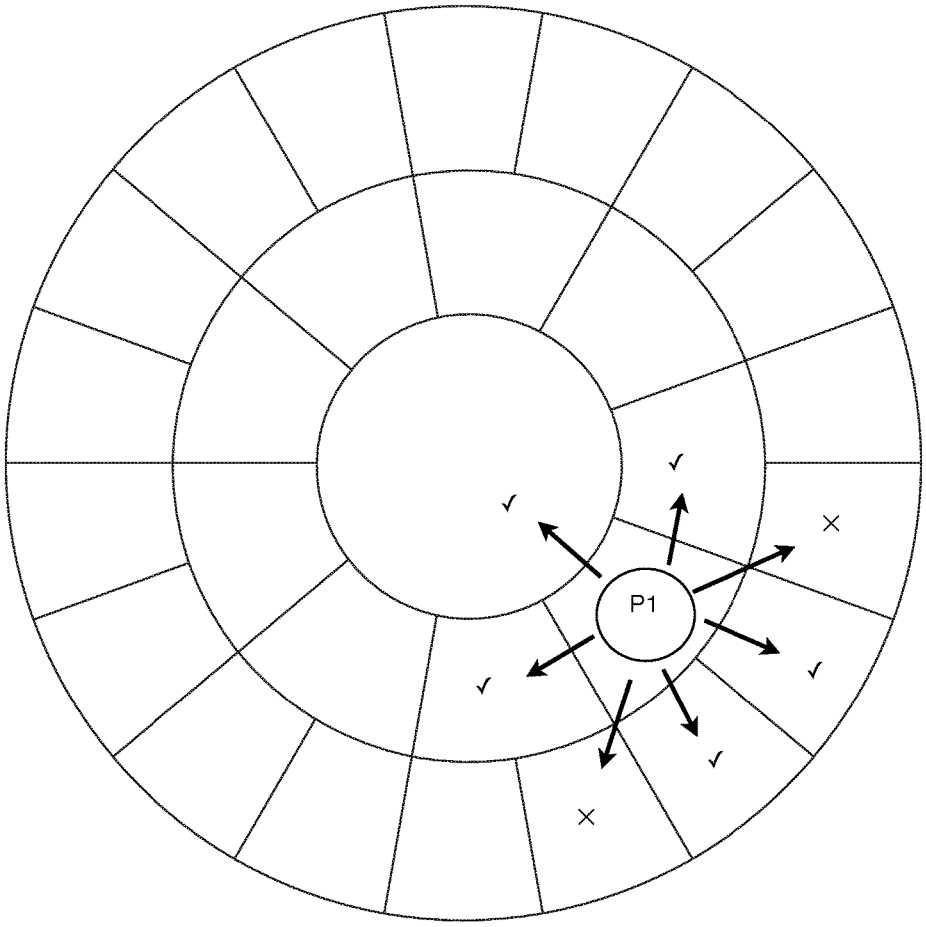
FIG. 2 is a view of a section of game board spaces indicating allowable moves in accordance with a preferred embodiment of the present invention.

The players alternate taking turns. They may move a pawn or challenge an opponent's pawn if the opponent's pawn is in an adjacent space. Players may move pawns around the ring they are currently in or move into an adjacent ring, including the center ring. Diagonal movement is not allowed in the preferred embodiment, though in alternate embodiments, diagonal movement may be allowed. As illustrated in FIG. 2, the arrows show potential game piece movement, and the check marks indicate allowable moves, while the X's indicate moves not allowed in the preferred embodiment, though alternate rules may be established. Only one pawn may occupy a space at a time.

Players may challenge an opponent's pawn if it occupies a space that they could move into if it were empty. The player occupying the space before the challenge is designated the Defender, and the other player is designated the Attacker for purposes of this description. When a challenge occurs, both players reveal their pawns type, i.e., Rock, Paper, or Scissors. As in the traditional hand game, Rock beats Scissors, Scissors beats Paper, Paper beats Rock. If the Attacker's pawn beats the Defender's pawn, the Attacker takes the Defender's pawn off the Board and moves into the space that had been occupied by the Defender. If the Defender's pawn beats the Attacker's pawn, the Defender takes the Attacker's pawn off the Board and remains in place. If both pawns are of the same type they remain in place and the Attacker's turn ends.

Captured pawns are left in plain sight so that both players can see which types have been taken.

After a challenge is over, the pawns that remain still in play are turned so that the type of pawn, i.e., Rock, Paper or Scissors, becomes hidden from the opposing player again.

The game ends when the center space is occupied by a pawn that cannot be taken, which can happen in two ways. First, by moving a pawn into the center after capturing all of the opponent's pieces that beat can it; and second, by capturing the last of all opponents' pieces that can take the piece currently in the center. For example: Green has a Scissors in the center ring and challenges Blue somewhere else on the Board taking Blue's last Rock. Green's scissors is now unable to be taken, ending play. It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by any issued claims.

What is claimed:

1. A game of strategy, memory and chance comprising:

two or more players, each player having a set of game pieces;

the set of game pieces being the same for each player in all respects except in some distinguishing characteristic so that each player can distinguish one player's game pieces from the one or more other player's game pieces;

each set of game pieces having the same front appearance, and each game piece having at least three types of back appearances, the first type winning over the second type, the second type winning over the third type and the third type winning over the first type;

a game board having a plurality of positions;

pre-designated game board positions are set for initial positioning of each player's game pieces such that each player may see the back of their respective game pieces and only the front of any other player's game pieces;

one of the game board positions being set at the beginning of play as the winning position;

in turn, each player may move any one of their game pieces to an adjacent open board position or may challenge another player to an adjacent board position occupied by that other player;

in the event of a challenge, each player reveals to the other the back of the player's game piece;

the game board position is then occupied by the winner and the losing piece is removed from the game board or the game piece positions are left unchanged in the event both game pieces are of the same type; and play ends upon one player occupying the winning position without being able to be successfully challenged by any remaining player.

2. A game as claimed in claim 1 wherein one of the players is a computer.

3. A game as claimed in claim 1 wherein the first type is illustrated by a rock, the second type is illustrated by a scissors and the third type is illustrated by paper.

4. A game as claimed in claim 1 wherein the game board comprises a set of concentric circles, each separated into one of more section indication positions.

5. A game as claimed in claim 2 wherein the rock is illustrated by a closed fist, paper is illustrated by an open hand with fingers touching each other, and scissors is illustrated by a hand having the index and middle fingers extended and separated.

6. A game of strategy, memory and chance comprising:

two or more players, each player having a set of game pieces;

the set of game pieces being the same for each player in all respects except in some distinguishing characteristic so that each player can distinguish one player's game pieces from the one or more other player's game pieces;

each set of game pieces having the same front appearance, and each game piece having at least three types of back appearances, the first type, illustrated by a rock, winning over the second type, the second type, illustrated by a scissors, winning over the third type and the third type, illustrated by paper, winning over the first type;

a game board having a plurality of positions;

pre-designated game board positions are set for initial positioning of each player's game pieces such that each player may see the back of their respective game pieces and only the front of any other player's game pieces;

one of the game board positions being set at the beginning of play as the winning position;

in turn, each player may move any one of their game pieces to an adjacent open board position or may challenge another player to an adjacent board position occupied by that other player;

in the event of a challenge, each player reveals to the other the back of the player's game piece;

the game board position is then occupied by the winner and the losing piece is removed from the game board or the game piece positions are left unchanged in the event both game pieces are of the same type; and play ends upon one player occupying the winning position without being able to be successfully challenged by any remaining player.

7. A game of strategy, memory and chance comprising:

two or more players, one of the players is a computer, each player having a set of game pieces;

the set of game pieces being the same for each player in all respects except in some distinguishing characteristic so that each player can distinguish one player's game pieces from the one or more other player's game pieces;

each set of game pieces having the same front appearance, and each game piece having at least three types of back appearances, the first type winning over the second type, the second type winning over the third type and the third type winning over the first type;

for the computer, the first type is illustrated by a closed fist, the second type is illustrated by a hand having the index and middle fingers extended and separated and the third type is illustrated by an open hand with fingers touching each other;

a game board having a plurality of positions;

pre-designated game board positions are set for initial positioning of each player's game pieces such that each player may see the back of their respective game pieces and only the front of any other player's game pieces;

one of the game board positions being set at the beginning of play as the winning position;

in turn, each player may move any one of their game pieces to an adjacent open board position or may challenge another player to an adjacent board position occupied by that other player;

in the event of a challenge, each player reveals to the other the back of the player's game piece;

the game board position is then occupied by the winner and the losing piece is removed from the game board or the game piece positions are left unchanged in the event both game pieces are of the same type; and play ends upon one player occupying the winning position without being able to be successfully challenged by any remaining player.

* * * * *